US005992103A

United States Patent [19]

Norman et al.

[11] Patent Number: 5,992,103

[45] Date of Patent: Nov. 30, 1999

[54] METHOD AND DEVICE FOR PERFORMING GROUND ANCHORAGE

[76] Inventors: Torbjorn Norman, Kyrkangsvagen 2, S-597 94; Steve Johansson, Skogslyckan, Hannas, S-597 96, both of Atvidaberg, Sweden, 970403

[21] Appl. No.: 08/811,765

[22] Filed: Mar. 6, 1997

[30] Foreign Application Priority Data

Apr. 11, 1995 [SE] Sweden ..... 9501353

[51] Int. Cl.[6] ..... E02D 5/80

[52] U.S. Cl. ..... 52/155; 52/158; 52/166; 52/745.21; 405/244; 405/259.1

[58] Field of Search ..... 52/155, 158, 166, 52/741.14, 745.21, 156; 405/244, 249, 259.1; 175/286

[56] References Cited

U.S. PATENT DOCUMENTS

| | | | |
|---|---|---|---|
| 1,408,007 | 2/1922 | Klein | 52/158 |
| 2,269,646 | 1/1942 | Burke | 405/244 |
| 3,735,541 | 5/1973 | Vanderlinde | 52/155 X |
| 3,797,260 | 3/1974 | Webb | 52/155 X |
| 4,160,613 | 7/1979 | Stanwick | 405/244 |
| 4,825,604 | 5/1989 | Manning | 52/155 X |
| 5,066,168 | 11/1991 | Holdeman | 405/249 |

FOREIGN PATENT DOCUMENTS

| | | |
|---|---|---|
| 364319 | 10/1981 | Australia . |
| 14 84 585 | 4/1975 | Germany . |
| 501 607 | 3/1993 | Sweden . |

*Primary Examiner*—Carl D. Friedman
*Assistant Examiner*—Winnie S. Yip
*Attorney, Agent, or Firm*—Merchant & Gould P.C.

[57] ABSTRACT

Method and arrangement for anchorage in the soil by means of a ground anchor (1) in the form of a tube (2) in which at least two axial slots **(3*a*, 3*b*) are arranged along at least one region of a tube wall in a part of the tube which is to be driven into the soil. This tube (2) is driven into the soil by cooperating with a pike (4) which is arranged in the tube (2) and which, after the tube has been driven in, is removed therefrom. The method according to the invention is characterized in that the tube (2) in at least one region with axial slots (3*a*, 3*b*) is subjected to a radial load by means of a tool (5)** which is sunk into the tube and which is actuated so as to exert a controllable expansion of the tube is brought about in this region. The tool is removed from the tube when a predetermined degree of expansion has been attained.

5 Claims, 5 Drawing Sheets

METHOD AND DEVICE FOR PERFORMING GROUND ANCHORAGE

FIELD OF THE INVENTION

The present invention concerns a method of anchoring in soil by means of a ground anchor in the form of a tube in which at least two axial slots are disposed along at least one region of a tube wall in a part of the tube which is to be driven into the soil, the tube being driven into the soil in co-operation with a pike disposed in the tube.

The invention also concerns an arrangement for anchoring in soil, said arrangement comprising a ground anchor in the form of a tube on which at least two axial slots are disposed along at least one region of a tube wall in a part of the tube which is to be driven into the soil.

The invention furthermore concerns a tool such that a tubular ground anchor can be radially expanded in a controlled manner by the method according to the invention.

BACKGROUND OF THE INVENTION

Processes for anchoring soil anchorages which are sunk to a greater or lesser depth, for example, when laying foundations, are well known. The currently most usual type of anchorage consists of a concrete anchorage cast at the intended anchorage site. This type of an anchorage is very demanding in terms of time since a casting mould firstly has to be dug in the soil before the concrete casting process itself can be performed. The concrete then has to be allowed to set before the anchorage is ready to be used. A further disadvantage of concrete anchorages is that they tend to disintegrate after a number of years' use. In order that the durability of the anchorage can be checked, it has to be laid bare.

In order to dispense with casting of anchorages it is also known to drive into the soil a metal object which, owing to its shape, is anchored in the soil when it has been driven in. However this type of anchorage or ground anchor is difficult to drive into the soil to a depth sufficient for the anchorage to support high loads. It is also already known to drive into the soil a metal tube, for example, which is then deformed so that reinforcement in the soil is attained.

DE-1 484 565 has already disclosed a ground anchor of the above-mentioned type. It consists substantially of a tube with a solid tip. A round bar is disposed in the tube and connected to the tip. Slots are formed in the tube above the tip. These slots are uniformly distributed along the tube and extend in the axial direction along the latter. This ground anchor is anchored in the soil as a result of the round bar and the tube disposed about the latter being driven into the soil. When the tube has been driven into the soil, an axial, upwardly directed force is applied to the round bar whilst the tube is held in place by an axially downwardly directed force. The round bar is therefore actuated such that it moves upwards out of the tube whilst the tube tip approaches the upper part of the tube. The shape of the tube is acted upon in the slotted region so that expansion of the tube is brought about in this region. The round bar can then be removed from the tube.

A disadvantage of this known type of anchorage is that it is unsuitable for deep anchorage and can only be used for ground anchors of very small dimensions. In the case of large tube dimensions and deep anchorage, the method is difficult to carry out, both practically and economically. Furthermore the method is unsatisfactory when a plurality of expanded regions are desired in each tubular anchorage in the ground.

SUMMARY OF THE INVENTION

The object of the present invention is to overcome the stated problem by providing a soil anchorage consisting of a ground anchor in the form of a tube with axial slots. This object is achieved by the method according to the invention which is characterized in that the tube in at least one region with axial slots is subjected to a radial load by means of a tool which is sunk into the tube and which is actuated so as to exert a controllable radial load on the interior of the tube in the direction towards the tube wall, whereby a controllable expansion of the tube is brought about in this region; and in that the tool is removed from the tube when a predetermined degree of expansion has been attained.

In order to permit further expansions of the ground anchor, according to a particular feature of the invention, each tube comprises two or more regions each having two or more slots.

According to a further particular feature of the invention, the radial load is applied in each slotted region in order to increase the bearing capacity of the anchorage.

In order to be able to evaluate the bearing capacity of the anchorage, according to a further feature of the invention, data concerning expansion are measured during the anchorage process, these measured data further being used to provide a preliminary geotechnical evaluation of the properties of the soil.

The object of the present invention is also to provide a ground anchor to be used according to the above method. This object is achieved by the arrangement according to the invention which arrangement is characterized in that the tube is open over its entire length and is arranged to be driven into the soil by means of a pike which is disposed in the tube and which has a lower pointed end and whose length is adapted such that the lower pointed end of the pike project out of the lower end of the tube during the driving-in process; in that, when being driven in, the pike and tube are operatively connected to each other at their respective upper ends, such that these upper ends can be made to move at the same time as the pike and tube are being driven in; and in that the pike is arranged to be removed from the tube when it has been driven in, whereupon the tube is arranged such that, at at least two opposite points on each side of the interior of the tube, midway between the slots, it can receive a radial load brought about by a tool sunk into the tube, the load being applied in the direction towards the tube, such that controllable expansion of the tube can be brought about in this region.

A further object of the present invention is to provide a tool for bringing about the controllable radial expansion of the tubular ground anchor when the method according to the invention is carried out. This object is achieved by the tool according to the invention which tool is characterized in that it comprises: a tool body adapted such that it can be sunk into the tubular ground anchor, at least two radially directed pistons which are disposed at equal spacings and movably mounted in corresponding radial recesses in the tool body, which recesses in one direction each open out at the periphery of the tool body and in another direction are each delimited by a base formed by the tool body; flow connections connecting the recesses at their respective bases to flow attachments on the exterior of the tool body; and means for attaching the flow attachments of the flow connections to a hydraulic source.

According to a particular feature of the invention, in order to distribute the force of the tool uniformly, there are three recesses and three pistons.

According to a further particular feature of the invention, in order to distribute the force of the tool uniformly over a large part of the periphery of the ground anchor there are four recesses and four pistons.

According to a final particular feature of the invention, the recesses are located at mutual substantially similar spacings axially along the length of the tool to allow a maximum piston stroke when the ground anchor expands.

BRIEF DESCRIPTION OF THE DRAWINGS

In the following the invention will be described with reference to the drawings, in which.

DETAILED DESCRIPTION OF THE INVENTION

The method according to the invention is intended to be used for tubular constructions of resilient material, for example a ground anchor 1 in the form of a steel tube 2. This steel tube is open over its entire length and is provided in two different regions of the tube 2 with two axial slots 3*a*, 3*b* disposed on each side of the steel tube. The slotted regions are to be driven into the soil.

During the process of driving into the soil a pike 4 is disposed in the tube 2. This pike has a lower pointed end 4*a* which facilitates driving into the soil in that, as it is driven in, it projects from the lower end of the tube. The pike reduces the load on the tube 2 during the driving-in process at the same time as the ground or other material in the soil is prevented from filling the tube. Owing to the pike 4, the tube 2 can be driven into the ground when it consists of rock or frozen soil. Whilst being driven in, the pike 4 and tube 2 are operatively connected to each other at their respective upper ends, such that these upper ends can be made to move at the same tine as the pike and tube are being driven in. When the tube 2 has been driven in to the desired depth, the pike is removed from the tube and can then be used again when a further tube is driven in. The driving-in process is performed mechanically, for example by means of a hydraulic hammer.

Figure 1:
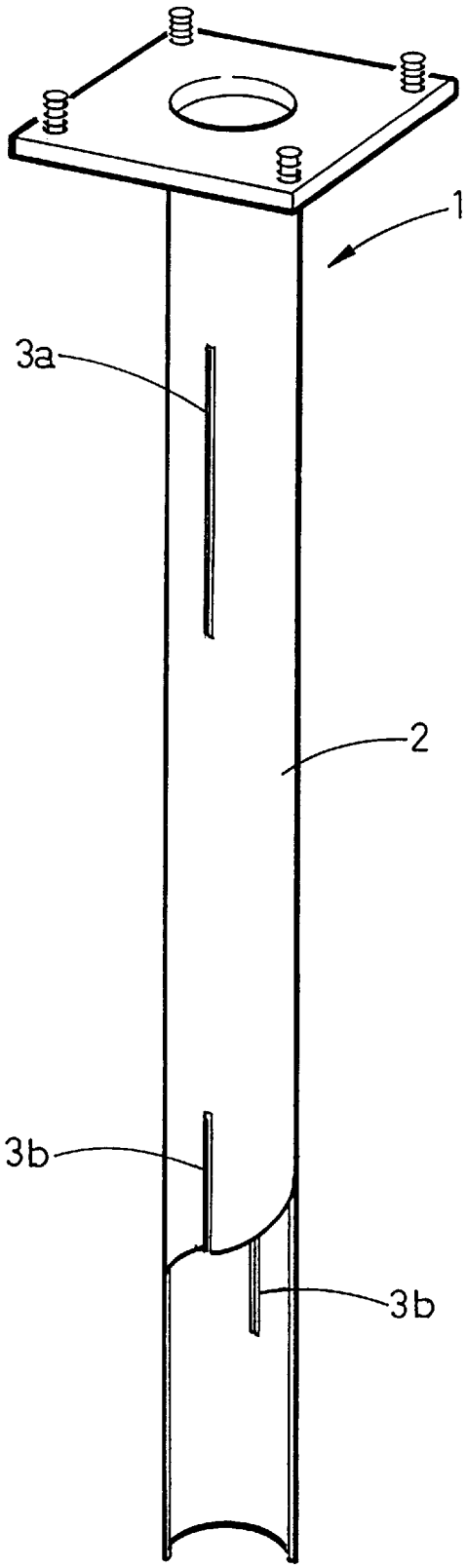
FIG. 1 shows a basic embodiment of a tubular ground anchor.
Figure 2:
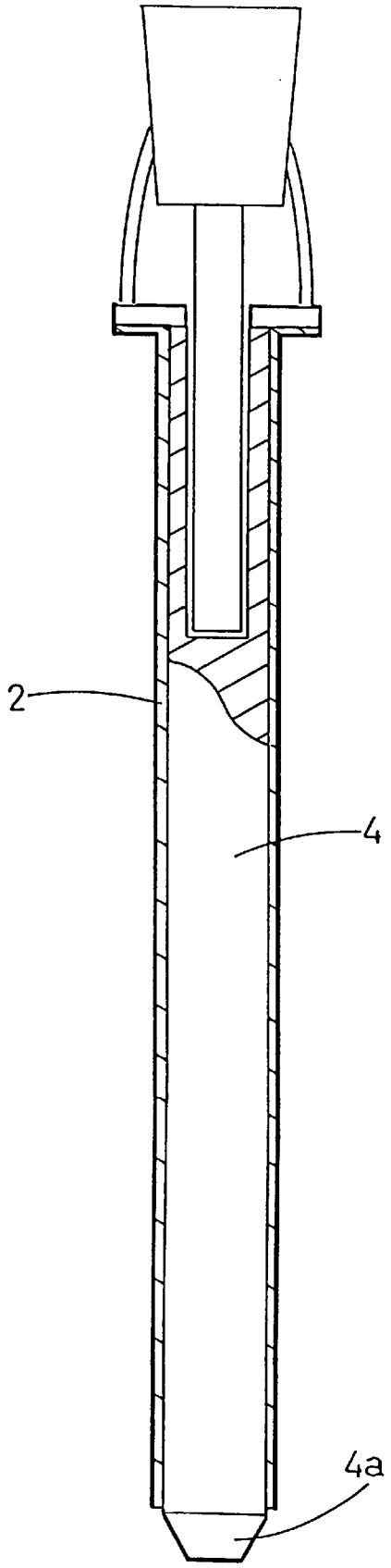
FIG. 2 shows the tubular ground anchor in FIG. 1 when it is being driven into the soil.
Figure 3:
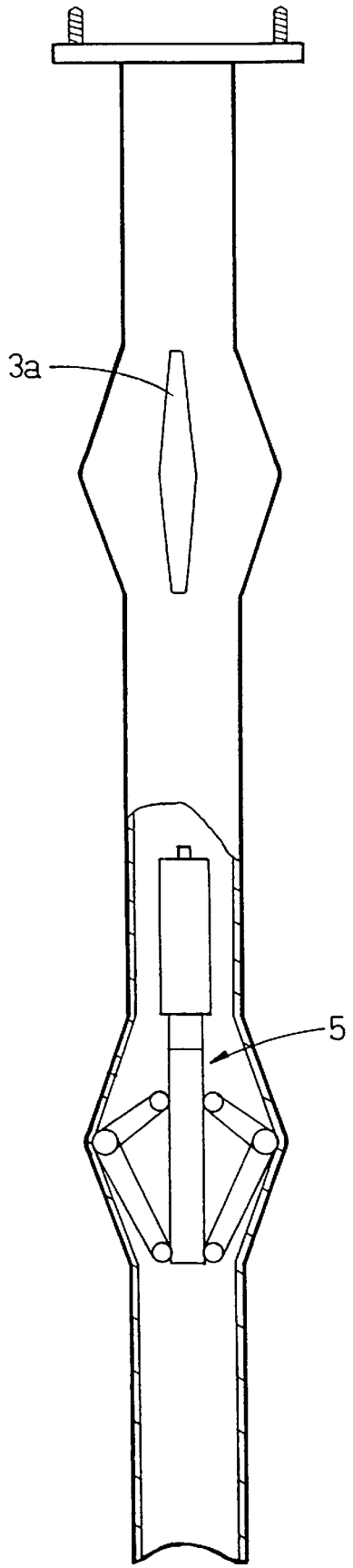
FIG. 3 shows the tubular ground anchor when the method according to the invention has been carried out.
Figure 4:
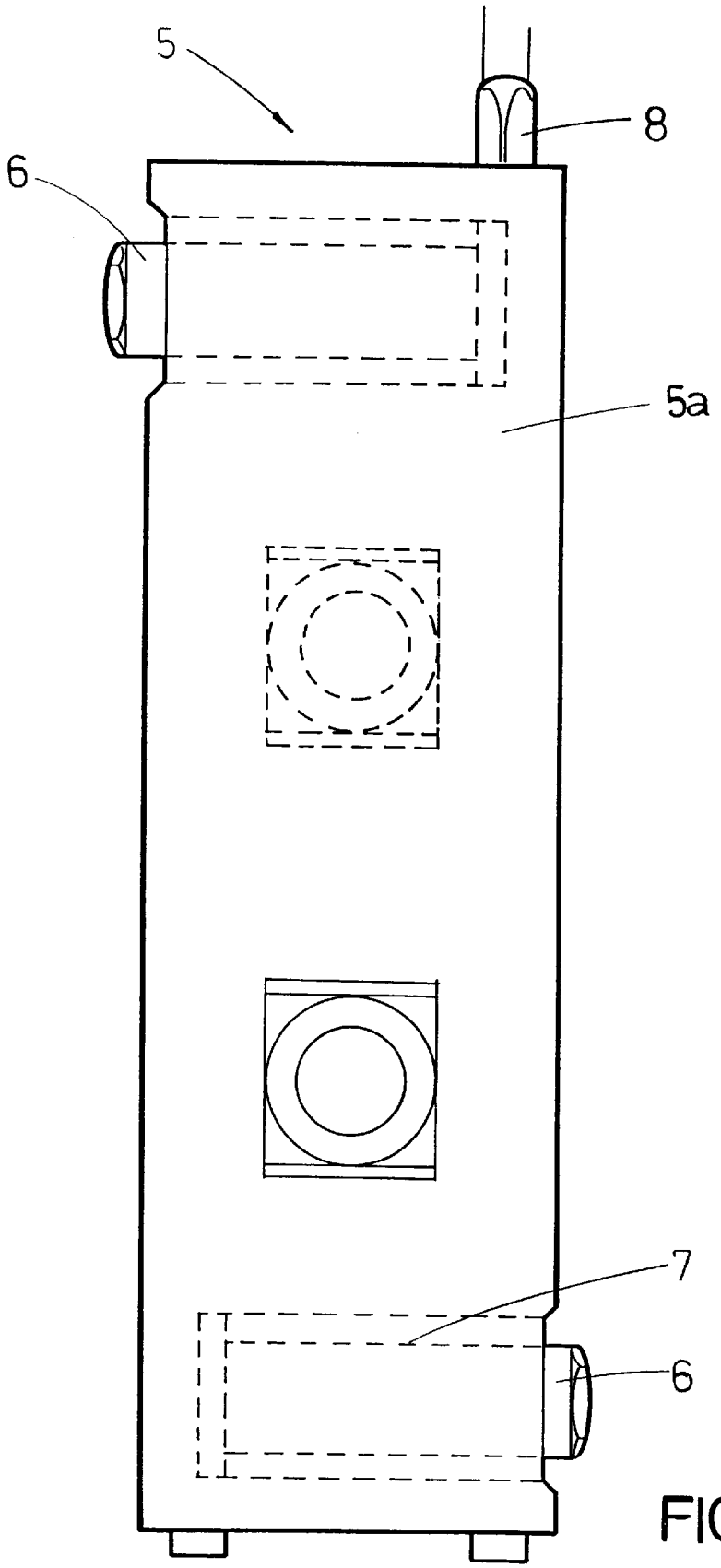
FIG. 4 shows in side view an example of a tool for carrying out the controllable radial expansion of the tubular ground anchor by means of the method according to the invention.
Figure 5:
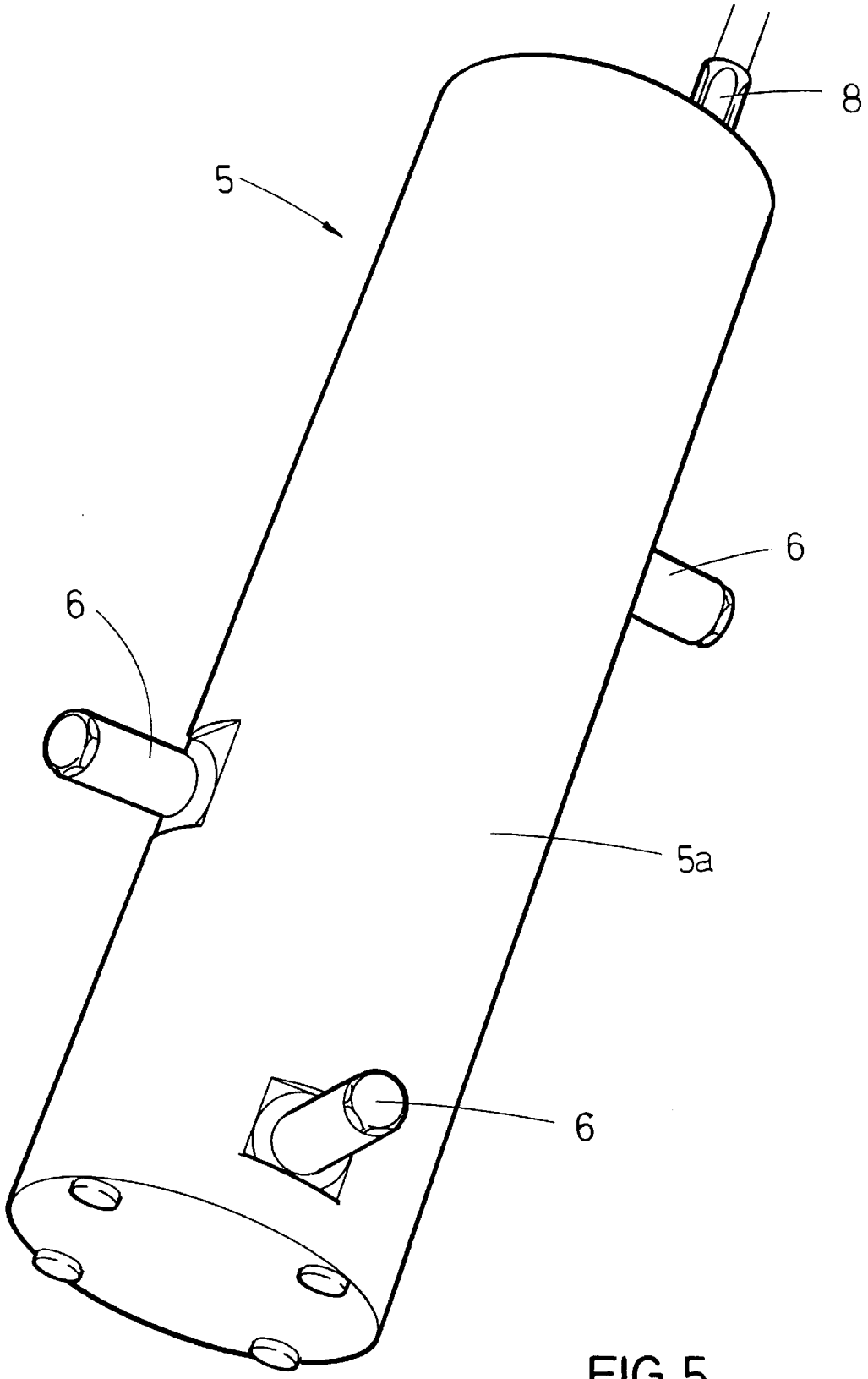
FIG. 5 shows the tool in FIG. 4, in perspective.

When the tube has been driven into the soil a tool 5 is disposed in the tube, which tool, in a flirt collapsed position, can easily be displaced in the tube 2. This tool can, for example, consist of the hydraulic tool 15 shown in FIGS. 4 and 5 but other tools are evidently also possible The tool 15 according to FIGS. 4 and 5 is especially adapted for carrying out the controllable radial expansion of the tubular ground anchor 1. The tool 15 consists of a tool body 15*a* which is adapted such that it can be sunk into the tubular ground anchor 1. The tool body 15*a* suitably consists of a solid steel unit. The tool body 15*a* comprises four radially directed pistons 6 which are located at uniform spacings about the periphery of the tool and which are movably mounted in corresponding radial recesses 7 in the tool body 15*a*. The recesses 7 are located at mutual substantially similar spacings axially along the length of the tool and each open out in one direction at the periphery of the tool body and are delimited in the other direction by a base formed by the tool body 15*a*, since the recesses do not pass through the entire tool body 15*a*. The recesses 7 are in the form of bores bored or milled in the tool body 15*a* for hydraulic pistons 6. The solid tool body 15*a* comprises flow connections which connect the recesses 7 at their respective bases to flow attachments 8 on the exterior of the tool body. The flow connections are to be attached to a hydraulic source via their flow attachments 8.

The hydraulic source is advantageously a double-action high-pressure pump with an operating pressure of up to 1000 bars. Located at the hydraulic source are arrangements for measuring pressure, flow and other significant parameters.

The possibility of measuring data concerning the expansion, i.e. pressure, flow, etc., whilst carrying out the anchorage process, enables the loads in terms of pressure, tension and torque, which the tubular ground anchor can withstand, to be established. The measured data can also be used to provide a preliminary geotechnical evaluation of the properties of the soil.

By virtue of the tool the region of the tube comprising axial slots 3*a*, 3*b* can be loaded in the radial direction. The load is applied on the interior of the tube in the direction towards the tube wall in a second, collapsed position of the tool. In this position the oil in the tool 15 has been pressurized so that the pistons 6 move outwards. Since all the recesses 7 are connected for flow to one another, when one of the pistons reaches maximum pressure, the oil flows on to the next recess until all the pitons 6 are in the outer position.

The slots 3*a*, 3*b* in the tube enable the latter to be expanded in this region if the load is applied at at least two opposite points, disposed on each side of the tube, midway between the slots. Expansion or deformation is thereby brought about in the region about the axial slots 3*a*, 3*b*. The radial expansion of the tube in the slotted region can be controlled by guiding the tool 15 sunk in the tube. It is thereby possible to adapt the anchorage better to the soil conditions.

If expansion is to be brought about in a given region, the tool is actuated so as to recover a shape suitable for its displacement in the tube. This is brought about in that the double-action hydraulic source is made to return the hydraulic oil such that the pistons 6 move into the tool body 15*a*. The tool 15 is then moved out of the tube 2 or to a region arranged for further expansion. The same tool can thus be used for carrying out further expansion of the tube 2 in a different region provided with axial slots 3*a*, 3*b*. The number of possible expansions in the tube is ultimately limited to the number of regions on the tube which are provided with axial slots. It will be appreciated that it may also be chosen not to expand the tube in a given region of the tube even though this region is provided with axial slots.

The invention provides a method of anchoring in the soil a ground anchor in the form of a tube 2, this method being easy to perform. The finished anchorage comprises a tube 2 which has been deformed in one or a plurality of regions such that the radial periphery of the tube 2 has increased in this region or these regions. However the tube has been deformed in such a way that cavities in this tube are retained over the entire length thereof. It is thereby subsequently easy to examine the tube, for example with respect to corrosion damage or the like.

It will be appreciated that the method according to the invention is not restricted to the use of the tool as shown in FIGS. 4 and 5; this tool is only one example of an arrangement by means of which radial expansion of a tubular ground anchor can be brought about in a given region of this tube.

What is claimed is:

1. A method of anchoring in ground using a tubular ground anchor having at least two axial slots disposed along at least one region of a wall thereof that is to be driven into the ground, the method comprising:

arranging a pike within the tubular ground anchor and driving the tubular ground anchor into the ground with the pike within the tubular ground anchor;

removing the pike from the tubular ground anchor after the tubular ground anchor has been driven into the ground;

placing a tool within the tubular ground anchor, the tool being actuatable so as to apply a controllable radial load on the wall of the tubular ground anchor;

applying a radial load to the wall of the tubular ground anchor in the region of the two axial slots using the tool, the radial load being sufficient to bring about a controlled expansion of the tubular ground anchor in the region of the two axial slots; and removing the tool from the tubular ground anchor when a predetermined degree of expansion has been attained.

2. The method according to claim 1, wherein the tube comprises at least two of said regions, each said region having at least two of said axial slots, and further comprising applying the radial load in each said region.

3. The method according to claim 1, further comprising measuring data concerning the expansion, and using the measured data to provide a preliminary geotechnical evaluation of the properties of the ground.

4. A ground anchor system, comprising:

a tube having upper and lower ends and at least two axial slots formed in a wall that defines the tube along at least one region of the tube that is to be driven into the ground, the tube being open over its entire length between the upper and lower ends;

a pike sized for removable disposition within the tube to aid in driving the tube into the ground, the pike including an upper end and a lower, pointed end, the upper end of the pike adapted to be operatively fixed to the upper end of the tube and the lower, pointed end projects out of the lower end of the tube when the upper ends of the pike and the tube are fixed together; and a tool sized for removable disposition within the tube, the tool including means for applying a controllable radial load to at least two opposite points on the interior of the tube adjacent the axial slots to thereby bring about a controlled expansion of the tube in the at least one region.

5. The ground anchor system according to claim 4, wherein the tube comprises at least two of said regions, each said region having at least two of said axial slots.

* * * * *